US009534380B2

(12) United States Patent
Gallocher

(10) Patent No.: US 9,534,380 B2
(45) Date of Patent: Jan. 3, 2017

(54) MODULAR CONSTRUCTION SYSTEM

(71) Applicant: MODULAR WALLING SYSTEMS LTD, Ayr (GB)

(72) Inventor: Stewart Gallocher, Ayr (GB)

(73) Assignee: MODULAR WALLING SYSTEMS LTD (GB)

( * ) Notice: Subject to any disclaimer, the term of this patent is extended or adjusted under 35 U.S.C. 154(b) by 0 days.

(21) Appl. No.: 14/371,617

(22) PCT Filed: Jan. 7, 2013

(86) PCT No.: PCT/GB2013/050013
§ 371 (c)(1),
(2) Date: Jul. 10, 2014

(87) PCT Pub. No.: WO2013/117892
PCT Pub. Date: Aug. 15, 2013

(65) Prior Publication Data

US 2015/0013266 A1 Jan. 15, 2015

(30) Foreign Application Priority Data

Feb. 9, 2012 (GB) ..... 1202273.7
Sep. 5, 2012 (GB) ..... 1215858.0

(51) Int. Cl.
*E04B 2/58* (2006.01)
*E04C 2/08* (2006.01)
(Continued)

(52) U.S. Cl.
CPC . *E04B 2/58* (2013.01); *E04B 2/60* (2013.01); *E04B 5/10* (2013.01); *E04C 2/08* (2013.01);
(Continued)

(58) Field of Classification Search
CPC ..... E04B 1/24; E04B 2/58; E04B 2/60; E04B 5/10; E04B 2001/2415; E04B 2001/2448; E04C 3/09; E04C 3/086; E04C 3/08; E04C 2/328; E04C 2/08; E04C 2002/001; E04C 2003/0421; E04C 2003/046; E04C 2003/0473; E04C 2003/0434; E04C 2003/0413; E04G 11/50; Y10T 428/12361; Y10T 428/16; Y10T 428/12354; B21D 11/20; B21D 47/04; B21D 5/08
See application file for complete search history.

(56) References Cited

U.S. PATENT DOCUMENTS 3,019,866 A * 2/1962 Grabowski ..... 403/4
3,094,197 A * 6/1963 Attwood ..... A47B 96/1408 29/521
(Continued)

FOREIGN PATENT DOCUMENTS

AU 5044396 10/1996
DE 20008768 U1 8/2000
(Continued)

OTHER PUBLICATIONS

International Search Report and Written Opinion dated Apr. 19, 2013 for PCT/GB2013/050013.
(Continued)

*Primary Examiner* — Joshua J Michener
*Assistant Examiner* — Matthew Gitlin
(74) *Attorney, Agent, or Firm* — Abel Law Group, LLP

(57) ABSTRACT

A modular construction system in which a number of three dimensional construction elements are adjoined to form a modular wall, ceiling or floor assembly. In their pre-assembly condition, each three dimensional construction element is formed from a planar metallic sheet (10) sub-divided by fold lines (12*a*, 12*b*) into panels (14, 16, 18) defining a multi-panelled sheet. Each panel lies in a common plane and at least one of the panels is deformable along its fold lines
(Continued)

out of said common plane to form an assembled three-dimensional construction element for adjoining to other three-dimensional construction elements. At least one panel is provided with an opening (14*a*, 16*a*) dimensioned to allow the passage of a reinforcement or stabilizing material through the assembled three-dimensional construction element.

28 Claims, 12 Drawing Sheets

(51) Int. Cl.

| | |
|---|---|
| ***E04C 3/08*** | (2006.01) |
| ***E04C 2/32*** | (2006.01) |
| ***E04B 5/10*** | (2006.01) |
| ***E04B 2/60*** | (2006.01) |
| ***E04G 11/50*** | (2006.01) |
| ***E04C 3/09*** | (2006.01) |
| *E04C 3/04* | (2006.01) |
| *E04C 2/00* | (2006.01) |

(52) U.S. Cl.

CPC ..... *E04C 2/328* (2013.01); *E04C 3/08* (2013.01); *E04C 3/086* (2013.01); *E04C 3/09* (2013.01); *E04G 11/50* (2013.01); *E04C 2002/001* (2013.01); *E04C 2003/046* (2013.01); *E04C 2003/0421* (2013.01); *E04C 2003/0473* (2013.01); *Y10T 428/12354* (2015.01); *Y10T 428/12361* (2015.01); *Y10T 428/16* (2015.01)

(56) References Cited

U.S. PATENT DOCUMENTS

| | | | | |
|---|---|---|---|---|
| 3,665,669 | A | 5/1972 | Huber | |
| 3,890,757 | A * | 6/1975 | Lamer et al. | 52/695 |
| 4,177,968 | A | 12/1979 | Chapman | |
| 4,545,170 | A * | 10/1985 | Shirey | 52/670 |
| 4,697,393 | A * | 10/1987 | Madray | 52/93.2 |
| 4,720,957 | A * | 1/1988 | Madray | 52/846 |
| 4,894,898 | A * | 1/1990 | Walker | B21D 47/01 29/416 |
| 5,473,850 | A | 12/1995 | Balding | |
| 5,720,144 | A * | 2/1998 | Knudson | E04C 3/07 29/416 |
| 6,910,311 | B2 * | 6/2005 | Lindberg | E04C 3/07 52/588.1 |
| 6,945,002 | B2 * | 9/2005 | Zambelli et al. | 52/630 |
| 7,263,869 | B2 * | 9/2007 | Durney et al. | 72/324 |
| 7,797,908 | B2 * | 9/2010 | Keys | E04C 3/086 29/897.35 |
| 7,908,811 | B2 * | 3/2011 | Ubilla | E04C 3/083 52/481.1 |
| 8,281,551 | B2 * | 10/2012 | Leek | E04H 9/02 52/295 |
| 2003/0014935 | A1 * | 1/2003 | Bodnar | 52/481.1 |
| 2004/0182041 | A1 * | 9/2004 | Bodnar | 52/731.9 |
| 2006/0207212 | A1 * | 9/2006 | Durney | E04B 2/78 52/846 |
| 2007/0056245 | A1 * | 3/2007 | Edmondson | 52/726.2 |
| 2007/0272342 | A1 * | 11/2007 | Holmes | B21D 47/01 156/73.5 |
| 2008/0006002 | A1 * | 1/2008 | Strickland et al. | 52/737.6 |
| 2008/0115445 | A1 | 5/2008 | Keys | |
| 2009/0139176 | A1 * | 6/2009 | Schroeder et al. | 52/656.1 |
| 2010/0005749 | A1 * | 1/2010 | Abdel-Sayed | E04B 1/24 52/650.2 |
| 2010/0319285 | A1 | 12/2010 | Jewett et al. | |
| 2012/0240508 | A1 | 9/2012 | Maisch | |
| 2013/0283592 | A1 * | 10/2013 | Maisch | B21D 47/04 29/428 |

FOREIGN PATENT DOCUMENTS

| | | | |
|---|---|---|---|
| DE | 10050801 | | 1/2002 |
| DE | 102009048152 | A1 | 4/2011 |
| EP | 0324206 | A1 | 12/1988 |
| GB | 2285071 | A | 6/1995 |
| WO | WO2005012663 | | 2/2005 |
| WO | 2011038879 | A2 | 4/2011 |

OTHER PUBLICATIONS

UKIPO Search Report issued in UK Application No. GB1202273.7; dated Jun. 11, 2012.

* cited by examiner

MODULAR CONSTRUCTION SYSTEM

The present invention relates to construction elements in both their pre-assembly (2D) and post-assembly (3D) conditions and particularly, but not exclusively, to the provision of a modular construction assembly comprising a plurality of construction elements fastened together to form walls, floors and ceilings. The invention may be used in isolation or in conjunction with steel frame construction methods currently forming the core components of steel framed buildings.

BACKGROUND TO THE INVENTION

When building large structures it is beneficial to reduce labour costs and minimise build times. This is particularly relevant to the construction of nuclear power plants where such efficiencies are necessary to allow nuclear power to become a more viable and realistic alternative fuel source to fossil fuels or other low capacity alternative sources.

Nuclear power plants and other sensitive structures including nuclear waste processing and/or storage facilities are required to withstand natural events such as earthquakes and hurricane force winds, and to contain large over-pressures. This necessitates substantial reinforcement of the building structure. Known reinforcement means employ a complex and expensive assembly of layered planar steel plates braced apart by a separate internal lattice of stiffening members and/or tie bars and/or shear studs, examples of which are shown in FIGS. 1*a* and 1*b*. A highly specialised and skilled work force—which itself is expensive and difficult to source—is required to assemble those presently available solutions.

Consequently, there exists a need for a simpler, more efficient and more cost-effective means of providing structural reinforcements to the nuclear and other industries.

SUMMARY OF THE INVENTION

According to a first aspect of the present invention there is provided a construction element in a pre-assembly condition comprising a metallic sheet sub-divided by one or more fold lines into panels to define a multi-panelled sheet wherein each panel lies in a common plane; at least one of the panels being deformable along said one or more fold lines out of said common plane to form an assembled three-dimensional construction element for adjoining to another three-dimensional construction element; and wherein at least one panel is provided with an opening dimensioned to allow the passage of a reinforcement or stabilising material through the assembled three-dimensional construction element.

In a non-limiting example, the metallic sheet is rectangular in shape and formed from a steel plate having a thickness of between 6 mm and 25 mm. However, wall thicknesses can be scaled according to individual requirements.

Optionally, the fold lines are each straight and mutually parallel.

In a non-limiting example, the fold lines each lie parallel to the opposing edges of the sheet such that all panels are rectangular in shape.

Optionally, the opening extends across the full width of the at least one panel between two fold lines.

Optionally, the opening is circular in shape.

Alternatively, the opening is oval, elliptical or hexagonal in shape.

Optionally, the major axis of the oval or elliptical opening extends perpendicularly with respect to each fold line.

By providing circular, oval or elliptical openings which extend across the full width of a panel to the, or each, fold line, regions of concentrated stress (also known as stress raisers) are reduced or eliminated. Oval openings have been found to be the best at reducing stress concentrations at the point where the opening meets the sidewall panels.

Optionally, the metallic sheet is sub-divided into only three panels.

Optionally, each panel has the same surface area.

Such an arrangement allows the sheet to be deformed into a symmetrical U-shaped channel shape whereby both sidewall panels have the same shape and size as the base panel.

Alternatively, at least one panel has a different surface area than the other panels.

In a non-limiting example, one sidewall panel is made smaller than the other sidewall panel so as to provide an asymmetrical U-shaped channel shape.

Optionally, each fold line is defined by a line of weakness formed by scoring, stamping or partially cutting the planar sheet.

Creating lines of weakness assists with the folding of the construction element into its three-dimensional assembled condition whilst reducing the costs associated with storage and transportation of the constructions elements whilst they are in their pre-assembly condition. The fold lines are located at predetermined positions depending on the intended final shape of the construction elements.

According to a second aspect of the present invention there is provided a three-dimensional construction element assembled from the multi-panelled sheet of the first aspect.

Optionally, the planes of adjacent panels are mutually perpendicular.

Optionally, the fold lines separating adjacent panels define curved adjoining edges.

The curved adjoining edges are a consequence of the folding process which is typically carried out by a mechanical press. Typically, the radius of curvature of the curved edges is small relative to the width dimension of each panel.

Optionally, the element comprises only a base panel and two sidewall panels which together define a U-shaped channel.

In a non-limiting example, a flooring module is constructed from a series of U-shaped channels fastened together, each having base panels measuring approximately 200 mm in width and sidewall panels measuring approximately 200 mm in height. Shear studs may be welded to one or more of the inner surfaces of the U-shaped channel. The studs may have a shank diameter of approximately 6 mm. Nelson® studs having an enlarged head are preferred. In an alternative non-limiting example, a wall module designed for aircraft impact resistance is constructed from a series of U-shaped channels fastened together, each having base panels measuring approximately 900 mm in width, sidewall panels measuring approximately 900 mm in height and Nelson® studs having a shank diameter of 19 mm. Importantly, tie bars are never required since the base panel of all U-shaped channels acts as an integral tie bar. The total length of a floor, wall or ceiling module constructed from a series of fastened U-shaped channel members can vary depending upon individual requirements. Module lengths of 12 m are readily achievable.

Optionally, distal edges of both sidewall panels comprise inwardly extending flange portions serving to reduce the spacing between their distal ends.

Optionally, the flange portions extend inwardly at an acute angle relative to the plane of each sidewall panel.

Optionally, the acute angle falls within the range of 30-60 degrees.

Optionally, the base panel and at least one of the two sidewall panels is provided with an opening dimensioned to allow the passage of a reinforcement or stabilising material.

Such an arrangement is particularly suitable for use in a flooring layer assembly whereby the openings in each sidewall panel allow for the vertical passage of, for example, concrete and the openings in each base panel allow for its horizontal passage along the entire flooring layer assembly.

According to a third aspect of the present invention there is provided a modular construction assembly comprising a plurality of three-dimensional construction elements according to the second aspect connected together to form a wall, ceiling or floor.

Optionally, adjacent three-dimensional construction elements are fastened together by welding and/or bonding and/or mechanical fasteners.

In this way complex shaped modular construction assemblies can be built from selected three-dimensional construction elements. In addition, a number of modular construction assemblies can be fastened together to make larger structures. The assembled construction elements and the modular construction assemblies themselves can be fastened to pre-existing structures such as floors or supports by welding and/or bonding and/or mechanical fasteners.

Optionally, each three-dimensional construction element comprises only a base panel and two sidewall panels which together define a U-shaped channel; wherein the base panel of one U-shaped channel is fastened along distal edges of both sidewall panels of its adjacent U-channel so as to form a lid closing the open top of the adjacent U-shaped channel.

In a non-limiting example, the construction elements are fastened together in a way which either presents a continuous planar sidewall surface (if both sidewall panels have the same surface area) or a multi-faceted surface (if one sidewall panel has a larger surface area than the other). When the construction assembly of the invention is to be used in combination with a steel frame construction system, interfacing U-sections could be formed by welding sidewall plates onto the flanges of a universal beam, universal column or cellular beam (c.f. WESTOK products EP 0 324 206 A1).

Optionally, the base panel of one U-shaped channel is fastened along distal edges of flanges on both sidewall panels of an adjacent U-channel so as to form a lid closing the open top of the adjacent U-shaped channel, and thereby defining outwardly facing recesses lying between the respective sidewall panels of adjacent U-shaped channels.

Optionally, each recess is covered by a metallic plate fastened between a sidewall/flange junction of one U-shaped channel and the base/sidewall fold line of an adjacent U-shaped panel.

Optionally, each covered recess defines a drainage channel.

In a non-limiting example, the fastening together of the adjacent U-shaped channels is performed by a first external weld within the recess before it is covered by the metallic plate. A second external weld which fastens the metallic plate creates a double barrier.

Optionally, the assembly is reinforced and/or stabilised by the introduction of reinforcement or stabilising material into the volumes defined by the base, sidewalls and lid of adjacent three-dimensional construction elements.

The ingress of, for example, radioactive material through the second external weld can be accommodated and dissipated within the vertical drainage channel thus avoiding seepage of radioactive material into the stabilising and/or reinforcement material contained within each U-shaped channel.

Optionally, the reinforcement or stabilising material is selected from concrete, resin, asphalt and particulate aggregate.

In a non-limiting example, the particulate aggregate may include sand, gravel, rubble or soil.

BRIEF DESCRIPTION OF THE DRAWINGS

The invention will now be described, by way of example only, with reference to the accompanying drawings in which.

DETAILED DESCRIPTION OF THE INVENTION

Figure 1A:
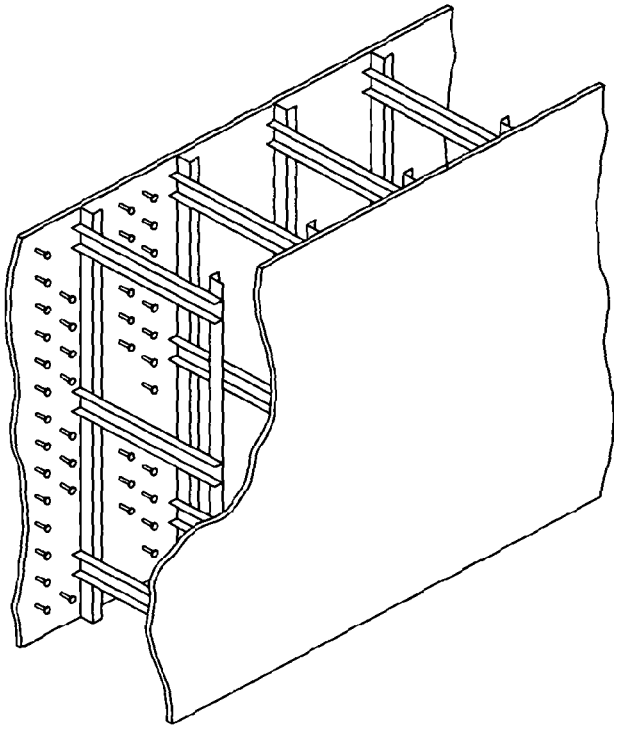
FIG. 1a (Prior Art)
FIG. 1*a* shows a prior art assembly of steel plates braced apart by a complex stiffening network.
Figure 1B:
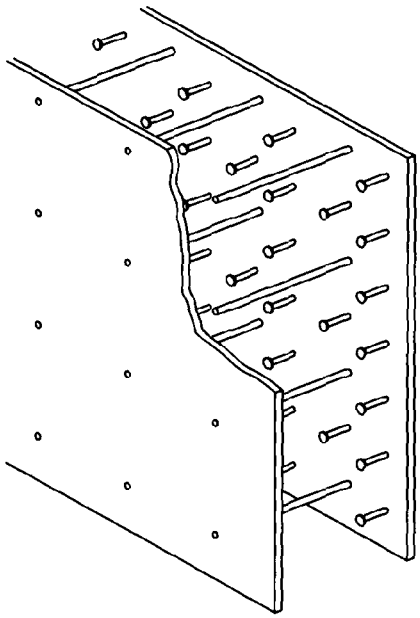
FIG. 1b (Prior Art)
FIG. 1*b* shows an alternative prior art assembly of steel plates braced apart by separate tie bars.
Figure 2A:
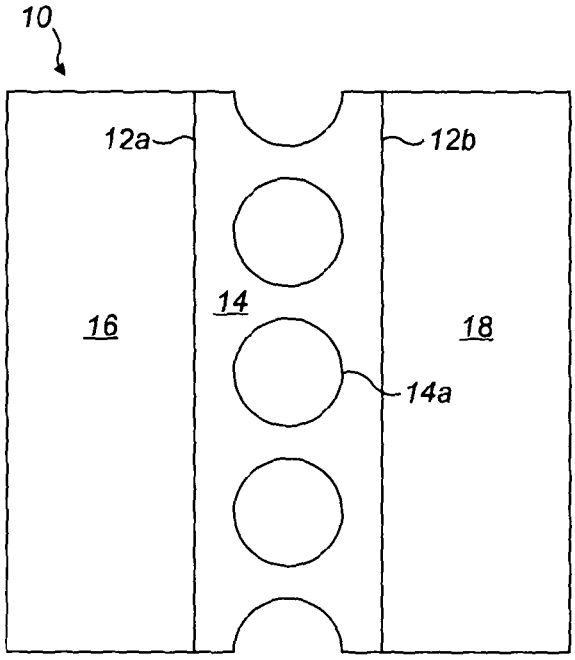
FIG. 2*a* shows a planar sheet having fold lines and apertures in accordance with an embodiment of the invention.

FIG. 2*a* shows a construction element in a two-dimensional pre-assembly condition before it is formed into a three-dimensional construction element. The construction element comprises a rectangular metallic sheet 10 subdivided by two straight, parallel fold lines 12*a*, 12*b* to define three panels 14, 16, 18 of equal dimensions. Each panel lies in a common plane. The material of the sheet may be plate stainless steel or carbon steel. Each fold line 12*a*, 12*b* comprises a line of weakness formed by scoring, stamping or partially cutting into the surface of the metallic sheet. The central panel 14 is provided with circular openings 14*a* equally spaced in a line along its length. The diameter of the openings 14*a* is at least 50% of the width of the central panel 14 between the fold lines 12*a*, 12*b*.

Figure 2B:
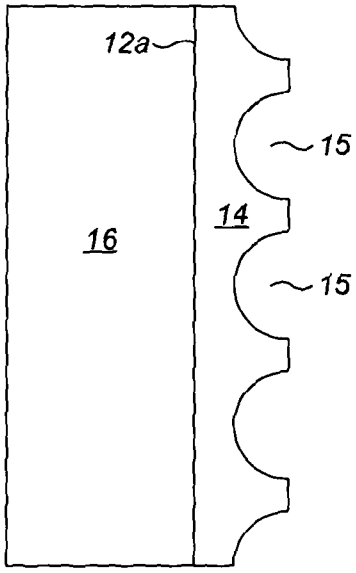
FIG. 2*b* shows a two-dimensional planar sheet portion which represents one half of the construction element of FIG. 2*a*.

FIG. 2*b* shows an alternative two-dimensional planar sheet portion which represents one half of the construction element of FIG. 2*a*. The sheet portion is shaped such that it comprises a series of spaced semi-circular recesses 15 located along one edge of the panel 14.

Figure 2C:
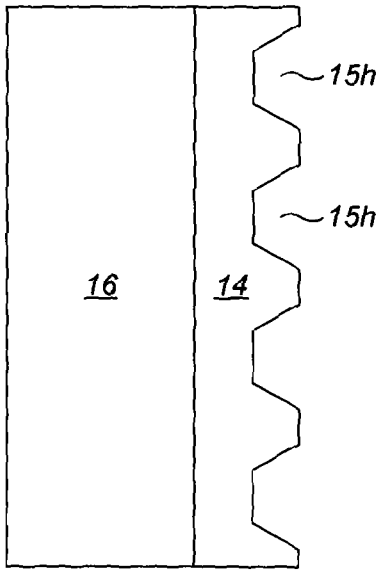
FIG. 2*c* shows an alternative two-dimensional planar sheet portion having a single fold line and an edge comprising a series of alternate semi-circular recesses and projections.

FIG. 2*c* shows a further alternative two-dimensional planar sheet portion which also forms one half of a construction element (not shown). The sheet portion is shaped such that comprises a series of spaced hexagonal recesses 15*h* located along one edge of the panel 14.

Figure 3A:
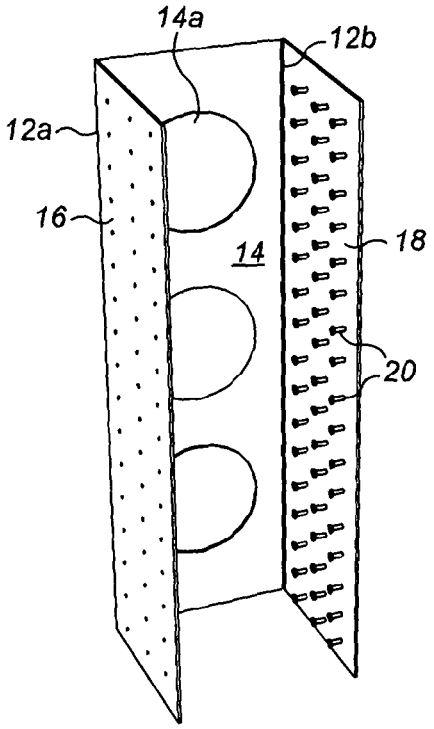
FIGS. 3*a-c* show two different three-dimensional construction elements and a construction assembly comprising a series of four individual construction elements fastened together.

FIG. 3*a* shows a three-dimensional construction element formed from a two-dimensional metallic sheet 10 similar to that shown in FIG. 2*a*. Sidewall panels 16, 18 have been deformed out of their initial common plane by forcible bending along their fold lines 12*a*, 12*b* so as to extend perpendicularly with respect to the base panel 14. The three-dimensional construction element therefore adopts a U-channel shape whereby the sidewall panels 16, 18 are opposed, substantially parallel and standing upright from the base panel 14 to define the U-channel. In the particular embodiment illustrated in FIG. 3*a*, an array of shear studs 20 are welded to the inwardly facing surfaces of the sidewall panels 16, 18. The shear studs may be Nelson® studs having heads which are enlarged relative to their shank widths.

In practice it has been found that, the process of manufacturing a three-dimensional three-panel construction element is made simpler by joining together two L-shaped two-panel halves. For example, two of the planar sheet portions shown in FIG. 2*b* may be forcibly bent along their respective fold lines 12*a* so that each panel 14 extends perpendicularly with respect to its panel 16. The two L-shaped panels may then be orientated such that their semi-circular recesses 15 are aligned to form circular openings 14*a* and then fastened together by, for example, welding the edge portions lying intermediate each opening 14*a*. It will be appreciated that this method of manufacturing the U-shaped channels is more practicable than forming two bends in a single three-panel construction element using a mechanical press. A further advantage is the two planar sheet halves can be manufactured from different grades of steel, e.g. stainless steel and carbon steel respectively.

The above process can also be employed using pairs of planar sheet portions as shown in FIG. 2*c*. The advantage of using planar sheet halves having hexagonal recesses 15 is that wastage of the metallic sheet material can be entirely eliminated during their manufacture when they are cut from a blank metallic sheet.

Figure 3B:
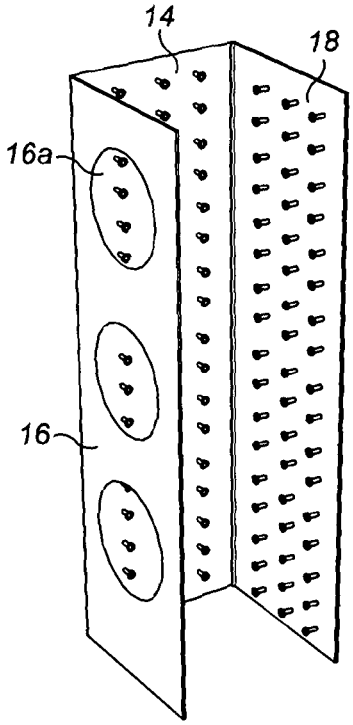

FIG. 3*b* shows an alternative three-dimensional construction element formed from a two-dimensional metallic sheet 10 (not shown). Sidewall panels 16, 18 have been deformed out of their initial common plane so as to define the same U-channel shape as shown in FIG. 3*a*. However, the openings 16*a* are provided in a sidewall panel 16 rather than in the base panel 12.

Figure 3C:
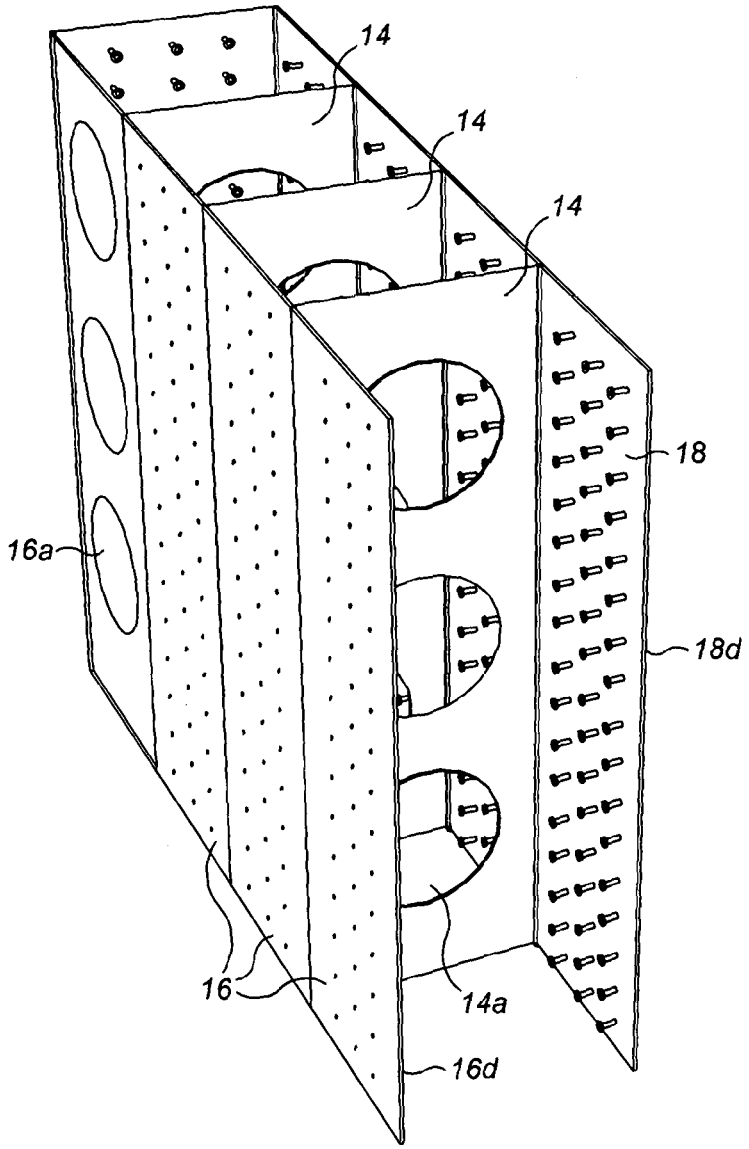

FIG. 3*c* shows a construction assembly comprising three construction elements according to FIG. 3*a* and one of the construction elements of FIG. 3*b*. Typically, the construction elements are orientated such that they stand on their end and their panels 14, 16, 18 extend vertically. The individual construction elements are identically orientated and aligned so as to be fastened together in series by, for example, welding the distal edges 16*d*, 18*d* of one U-channel to the outer edges of the base panel 14 of another U-channel. In doing so, the adjoined sidewall panels 16, 18 present substantially planar exterior surfaces of a double-skinned assembly, and each base panel 14 closes the open top of the U-channel to which it is fastened. The exact manner of the connection between adjacent U-channels is described in more detail below. When fastened together in this way the openings 14*a* are aligned to define an internal passage through the interior of the construction assembly between its opposing sidewalls 16, 18. The construction element of FIG. 3*b* may act as a 'corner' element serving to change the direction of the internal passage by 90 degrees.

Figure 4A:
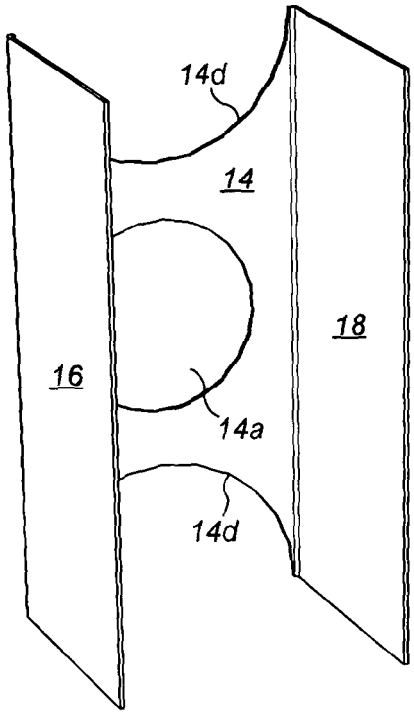
FIGS. 4*a-c* show two alternative three-dimensional construction elements and a construction assembly comprising a series of eight individual construction elements fastened together.

FIG. 4*a* shows a three-dimensional construction element having a single circular opening 14*a* formed centrally in its base panel 14 but spaced from the fold lines 12*a*, 12*b*. The opposing free edges 14*d* of the base panel 14 are each arcuate in shape across their full width between the opposing fold lines 12*a*, 12*b*.

Figure 4B:
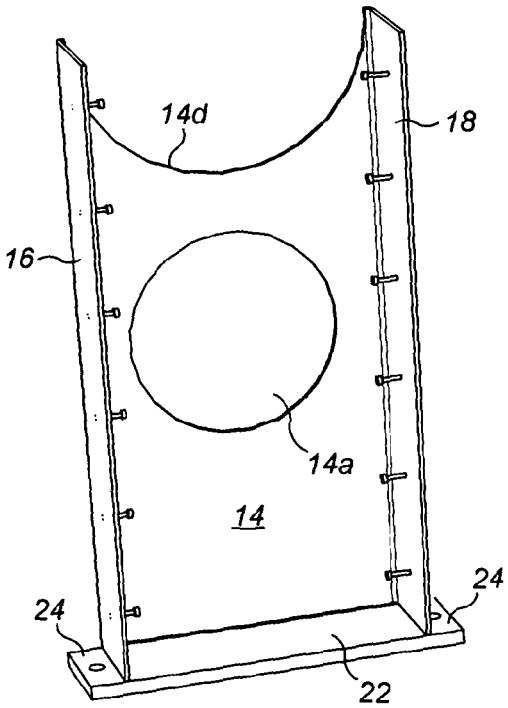

FIG. 4*b* shows a three-dimensional construction element similar to that of FIG. 4*a*. However, the lower edge of the base panel 14 extends in a straight line between two sidewall panels 14, 16 of reduced height. An end plate 22 is fastened to the construction element by, for example, welding it to the free edges of the base panel 14 and the two sidewall panels 16, 18 to close off one end of the U-channel. The end plate 22 is over-sized in the lateral direction such that two flanges 24 extend outwardly at right angles relative to the sidewall panels 16, 18. Openings may be provided in the flanges 24 to allow the end plates 22 to be mechanically fastened to a floor or other structure.

Figure 4C:
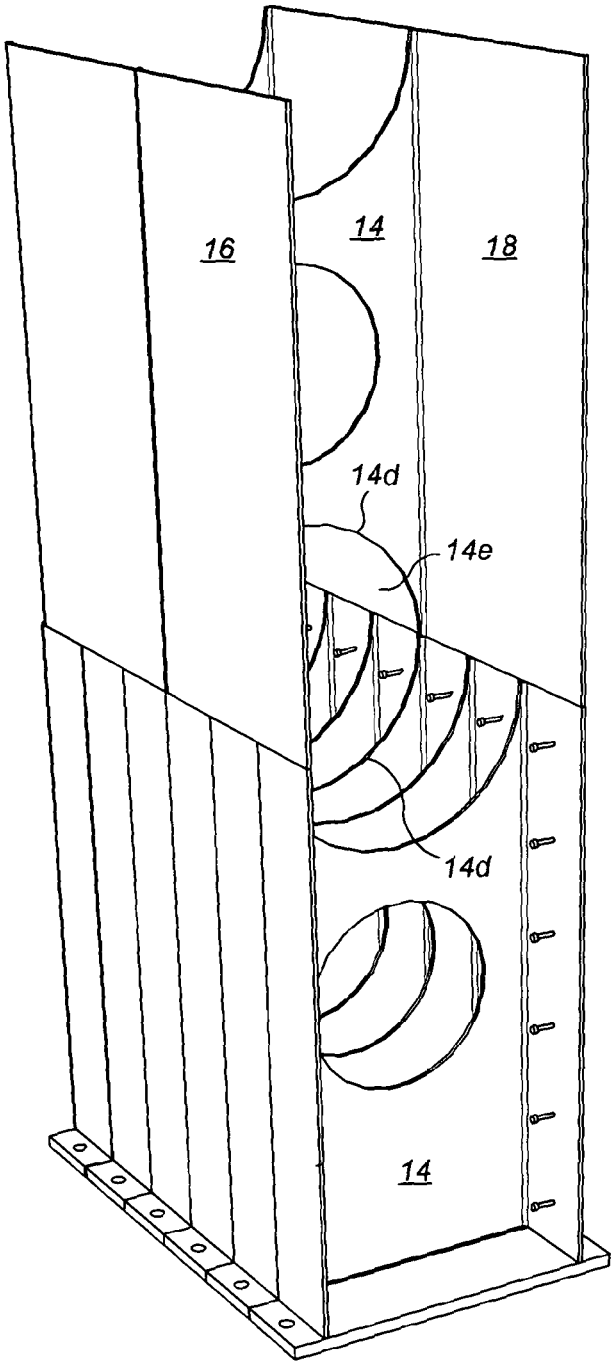

FIG. 4*c* shows a construction assembly comprising six construction elements according to FIG. 4*b* beneath two construction elements of FIG. 4*a*. The individual construction elements in each row are fastened together in series by, for example, welding the distal edges 16*d*, 18*d* of one U-channel to the base panel 14 of another U-channel so that the adjoined sidewall panels 16 and the adjoined sidewall panels 18 present substantially planar exterior surfaces. The end plates 22 of the lower row of six construction elements combine to form a contiguous end support panel. The other two construction elements forming the upper row are fastened together in the same manner as described above with reference to FIG. 3*c*. The two rows are fastened together by, for example, welding along edges of the sidewall panels 16, 18 extending perpendicularly with respect to the bases 14.

In the particular embodiment shown in FIG. 4*c*, the height of the sidewall panels 16, 18 of each individual construction element in the lower row is equal to one third of the height of each individual construction element in the upper row. This provides additional strength at the lower row. Once the assembled upper row of construction elements is mounted onto the assembled lower row, the arcuate free edges 14*d* of each base panel 14 on each upper row construction element align with a like arcuate free edge 14*d* of a base panel 14 of the lower row construction element to create an additional row of openings 14*e*. The openings 14*e* extend fully across the gap between the opposing sets of adjoined sidewall panels 16, 18. By creating a full width arcuate free edge 14*d*, all straight free edges of the base panel are removed. It will be appreciated that this arrangement eliminates the need for any fastening together of base panels 14 to be performed from within the U-shaped channels since all parts of the arcuate free edges 14*d* of adjoining base panels 14 remain spaced apart when rows of construction assemblies are mounted one on top of the other. It is very advantageous to be able to perform all fastening together, e.g. by welding, from the outside of each assembled row of U-shaped channels. Furthermore, since individual rows of construction assemblies are pre-assembled, only a horizontal weld is required to fasten together adjacent rows. The full width arcuate free edges 14*d* also serve to eliminate or reduce stress concentrations where the arcuate free edges 14*d* meet each sidewall panel 16, 18.

Figure 5A:
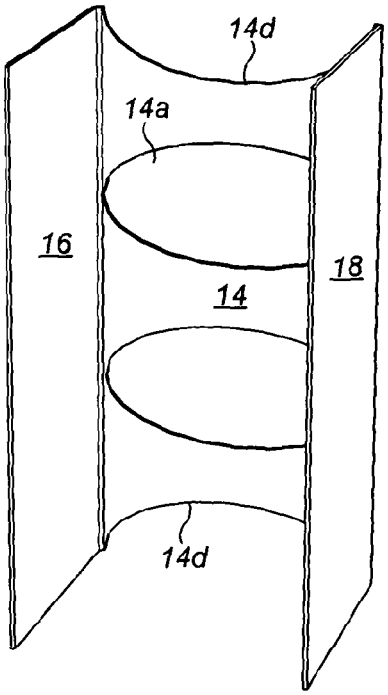
FIGS. 5*a* and 5*b* show a further alternative three-dimensional construction element and a construction assembly comprising two individual construction elements fastened together.
Figure 5B:
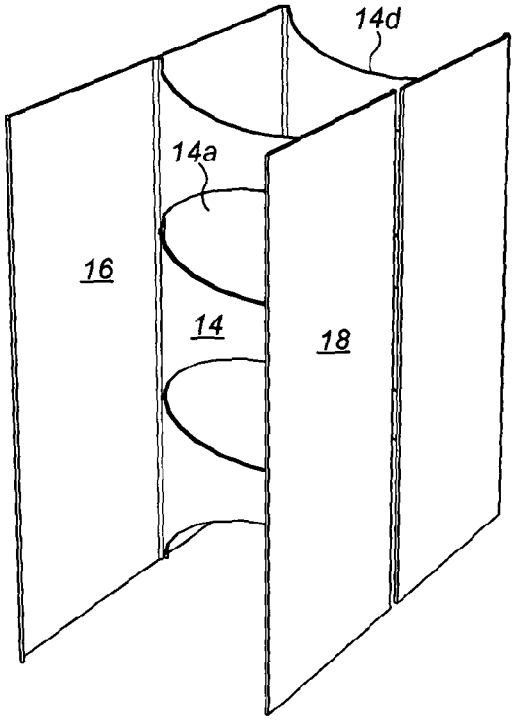

FIG. 5*a* shows a three-dimensional construction element having two elliptical openings 14*a* formed in its base panel 14. The elliptical openings extend across the full width of the base panel 14 between its fold lines 12*a*, 12*b*. The opposing free edges 14*d* of the base panel 14 are each arcuate in shape and also extend across the full width of the base panel between its opposing fold lines 12*a*, 12*b*. FIG. 5*b* shows a construction assembly comprising two construction elements according to FIG. 5*a* fastened together in series. The arcuate shape of the opposing free edges 14*d* is a half-ellipse such that they may form further elliptical openings when multiple rows of connected elements are stacked one on top of the other as described above with respect to FIG. 4*c*. By employing full-width opposing free edges 14*d*, all fastening can be performed from the outside of each assembled row of U-shaped channels as noted above.

Figure 6A:
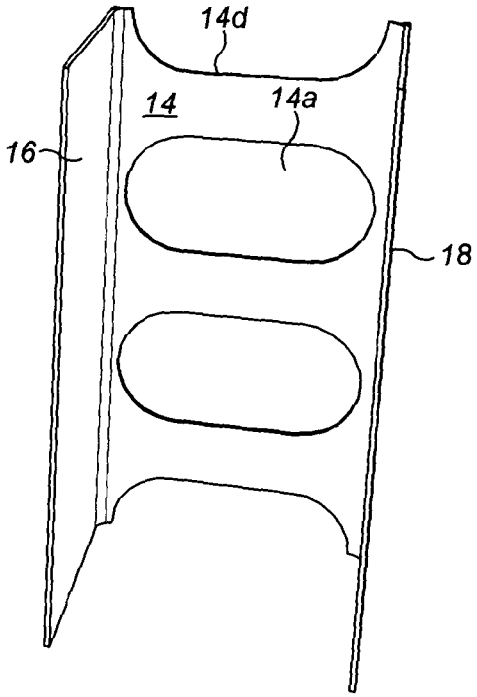
FIGS. 6*a* and 6*b* show a yet further alternative three-dimensional construction element and a construction assembly comprising thirteen individual construction elements fastened together.
Figure 6B:
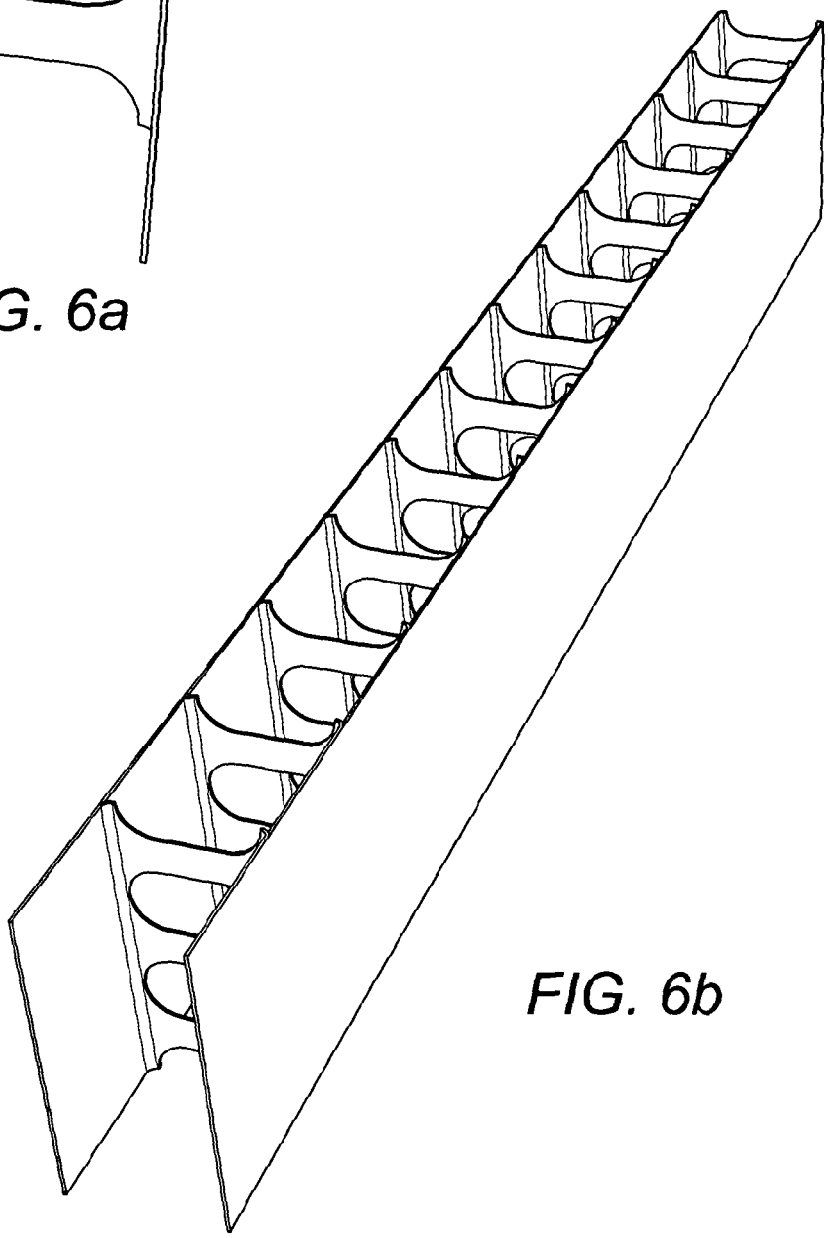

FIG. 6*a* shows a three-dimensional construction element having two oval openings 14*a* formed in its base panel 14. The oval openings extend across the full width of the base panel 14 between its fold lines 12*a*, 12*b*. The opposing free edges 14*d* of the base panel 14 are each arcuate in shape and also extend across the full width of the base panel between its opposing fold lines 12*a*, 12*b*. FIG. 6*b* shows a construction assembly comprising thirteen construction elements according to FIG. 6*a* fastened together in series. The arcuate shape of the opposing free edges 14*d* is a half-oval such that they may form further oval openings when multiple rows of connected elements are stacked one on top of the other as described above with respect to FIG. 4*c*. Again, by employing full-width opposing free edges 14*d*, all fastening can be performed from the outside of each assembled row of U-shaped channels as noted above.

Figure 7A:
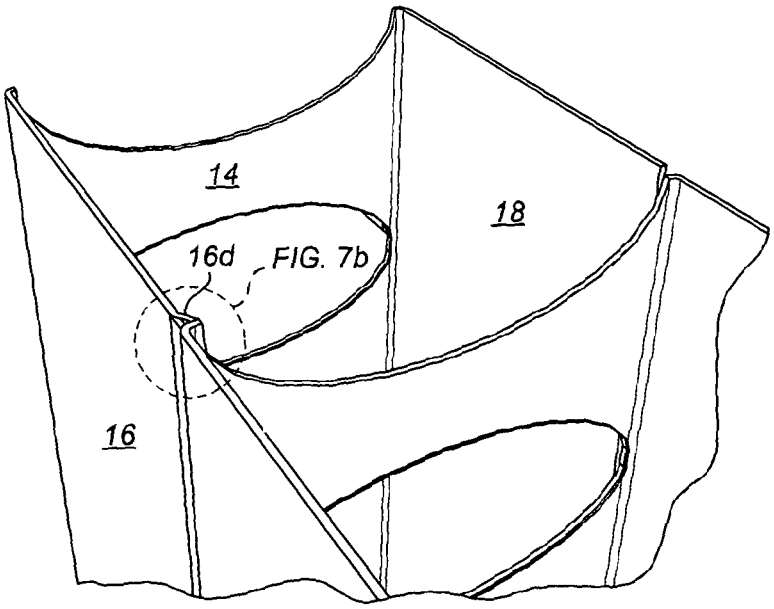
FIG. 7*a* shows a construction assembly comprising two individual construction elements of FIG. 5*a* fastened together to define a covered recess along the line of their connection.
Figure 7B:
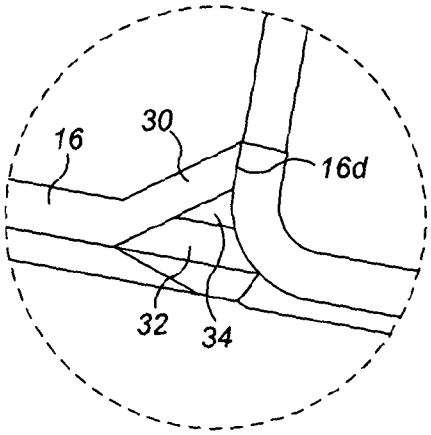
FIG. 7*b* shows the covered recess of FIG. 7*a* in greater detail.

FIG. 7*a* shows a non-limiting example of how individual U-channel construction elements may be fastened together in series. The sidewall panel 16 extends away from its base panel 14 and terminates in a distal edge 16*d* extending along its full length parallel to the plane of the base panel 14. The distal edge 16*d* is located on a flange 30 which extends inwardly towards the opposing sidewall panel 18 at a 45 degree angle. As can be seen in FIGS. 7*a* and 7*b*, the width of the flange 30 is narrow relative to the total height of the sidewall panel 16. Typically, the width of the flange 30 will be less than 10% of the height of the sidewall panel 16. As is shown more clearly in FIG. 7*b*, the distal edge 16*d* has a chamfered 45 degree angle so as to mate with the plane of a base panel 14 of another U-channel construction element inwardly of its curved fold line 12*a*. The inward angle of the flange 30 creates an elongate concavity or recess between adjoining sidewall panels 16. The chamfered distal edge 16*d* is fastened to the adjoining base panel 14 by welding from the exterior. Subsequently, a covering plate 32 is partially inserted into the recess and welded—from the exterior—to the flange 30 of one U-channel and the curved fold line 12*a* of the adjoining U-channel respectively. A drainage channel 34 is created behind the covering plate 32. Although not illustrated in the figures, the other sidewall panel 18 is connected to the curved fold line 12*b* of the adjoining U-channel in the same manner. Such an arrangement may be particularly beneficial if the construction assembly is to form the wall of, for example, a spent fuel pool. In particular, if any leakage occurs through the exterior (wet) face of the wall assembly, liquids are accommodated and dissipated within the vertical drainage channel 34 thus avoiding seepage of radioactive material into the stabilising and/or reinforcement material contained within each U-shaped channel.

Figure 8A:
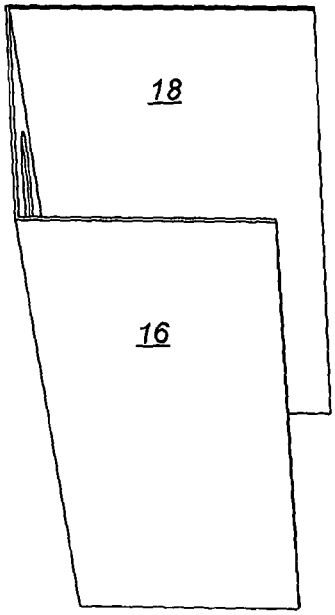
FIG. 8*a* shows a construction element having sidewalls of different heights and surface areas.
Figure 8B:
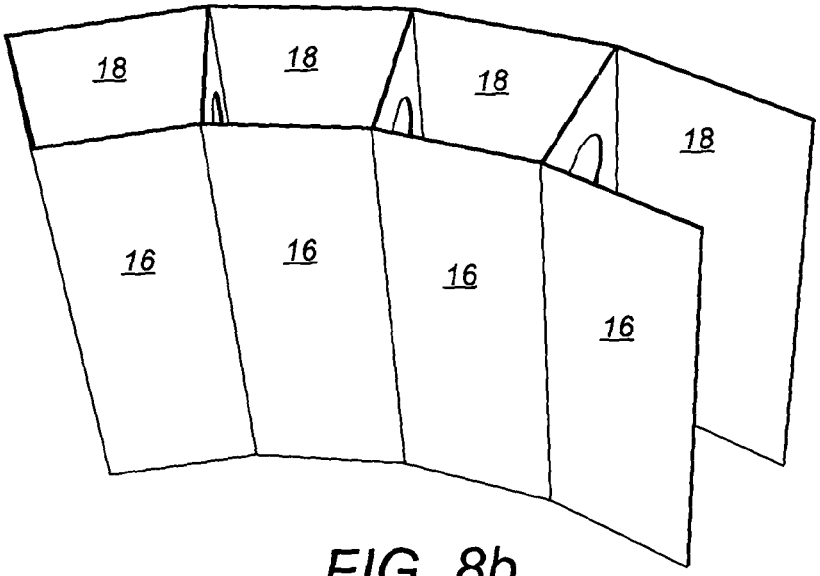
FIG. 8*b* shows a construction assembly comprising four individual construction elements of FIG. 8*a* fastened together.

FIG. 8*a* shows that by varying the spacing of the fold lines 12*a*, 12*b* in metallic sheet 10 asymmetric U-channel shapes are created. Since the height of sidewall panel 16 is less that the height of sidewall panel 18, a series of such construction elements fastened together curves in the direction of the smaller sidewall panel 16 as shown in FIG. 8*b*. The average radius of curvature of the curved assembly can be varied by changing the relative dimensions of the sidewall panels 16, 18. Asymmetric U-channel shapes can also be manufactured from two differently dimensioned L-shaped panel portions in a similar manner to that described above with respect to FIGS. 2*b* and 2*c*.

Figure 9A:
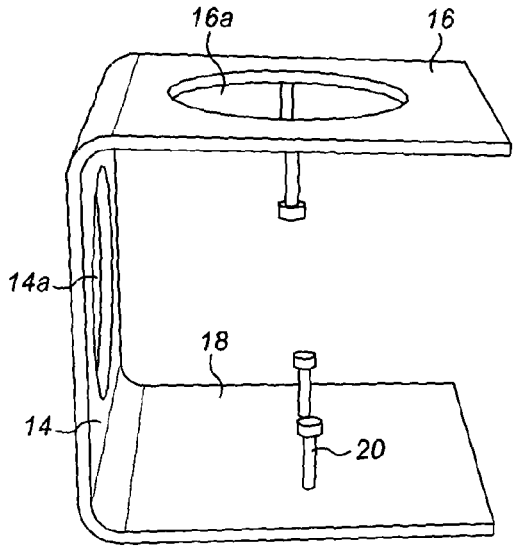
FIG. 9*a* shows a construction element having openings in both its base panel and one of its sidewall panels.
Figure 9B:
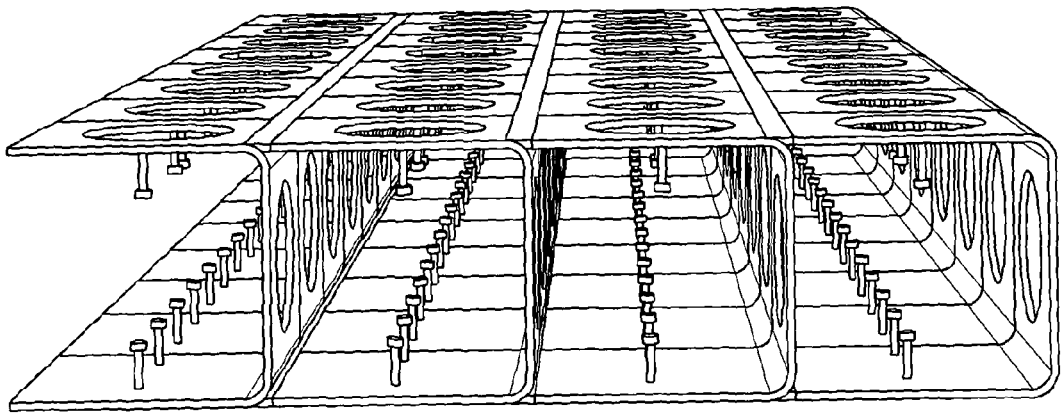
FIG. 9*b* shows a construction assembly comprising thirty two individual construction elements of FIG. 9*a* fastened together to form a floor or ceiling unit.

FIG. 9*a* shows a U-channel construction element whereby both the base panel 14 and one sidewall panel 16 are provided with a central circular opening 14*a*, 16*a*. Two Nelson® studs 20 extend from either side of the circular opening 16*a*, and from the opposing sidewall panel 18. All three panels 14, 16, 18 are square. The U-channels may be aligned and fastened together to form a construction assembly as shown in FIG. 9*b*. Such an arrangement may be particularly suitable for use as a floor assembly. This is because concrete can be introduced through the upper horizontal openings 16*a* and spread horizontally through the vertical openings 14*a* formed in each base panel 14. Once the concrete sets around the Nelson® studs 20 a composite deck is formed having a large span capacity suitable for flooring assemblies. Instead of being constructed from 32 separate square construction elements, the floor assembly could instead comprise of four elongate construction elements each having sixteen circular openings 14*a*, 16*a*.

The exact shape, size and position of the openings 14*a*, 16*a* in all of the construction elements described above is not critical, provided that the selected reinforcement or stabilising material is able to pass through. The sizes of the openings are also selected having regard to the required residual strength of the panels of the construction element, and the elimination or reduction of stress raisers. For example a concrete with coarse aggregate filler may require larger apertures than a fibre-filled resin.

Figure 10:
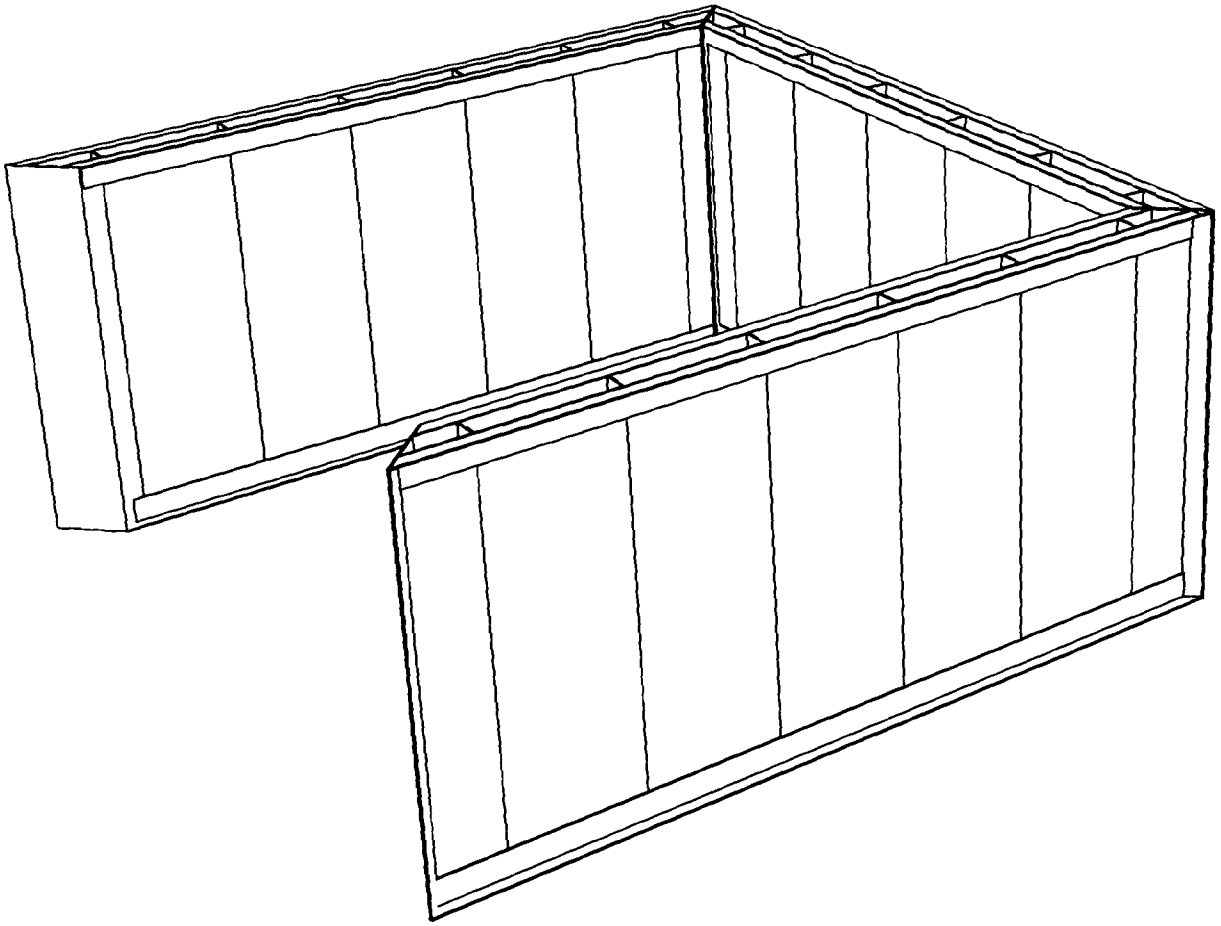
FIG. 10 shows a modular construction comprising three different construction assemblies connected together to form a wall structure.

It will be appreciated that the apparatus of the present invention provides a versatile lightweight modular construction system capable of being used to form reinforced structural walls (see FIG. 10), partitions, extended support surfaces, floors, ceilings and roofs etc. The system enables rapid assembly of a planned construction but is flexible enough to accommodate ad hoc on site changes to meet unforeseen challenges. The modular design also accommodates existing construction practice for pouring concrete, filling with insulation resins etc. without requiring any special training or substantial changes in work practices for installing those secondary construction materials. In more complex structures modular assemblies can be fastened vertically to other modular assemblies in order to form a modular construction system having tiers, floors or levels of modular assemblies. In this way complete structures can be formed having a number of different levels with floors, ceiling and walls all in place. In addition the modular assemblies may be provided with utilities, conduits, ducts, wiring for electrical circuitry and additional structural elements such as to form stairs or the like so that such elements are available on each level of the final structure so that only minimal final construction is required on site.

An advantage of the present invention is that it can be used in the construction of large structures but it can also be used or is applicable to Fastrak® construction methods, such as the core walls of steel framed buildings. However, it should be understood that its use is not limited to such and it can be used in a wide range of applications, building and construction methods all of which will be understood by a person skilled in the art.

The invention claimed is:

1. A building structure comprising a modular assembly of a plurality of building reinforcements comprising:

two separate L-shaped elements that form an opening dimensioned to allow the passage of a reinforcement or stabilizing material, said L-shaped elements being joined together to assemble said building reinforcement that is three-dimensional and defines a U-shaped channel, each of said L-shaped elements including mutually perpendicular panels;

each of said L-shaped elements being formed of a steel plate having a thickness of between 6 mm and 25 mm and being sub-divided by a fold line into said panels;

each said panel being deformed along said fold line out of a common plane to form the L-shaped elements, wherein each said building reinforcement comprises only a base panel and two sidewall panels which together define said U-shaped channel; and wherein the base panel of one U-shaped channel is fastened along distal edges of both sidewall panels of its adjacent U-shaped channel so as to form a lid closing the open top of the adjacent U-shaped channel;

wherein adjacent said building reinforcements are fastened together by at least one of welding, bonding and mechanical fasteners;

wherein a plurality of said fastened building reinforcements form said modular assembly;

wherein the building structure is selected from a wall, ceiling or floor.

2. A building structure comprising said modular assembly of a plurality of said building reinforcements according to claim 1, wherein the fold lines of said L-shaped elements are each straight and mutually parallel.

3. A building structure comprising said modular assembly of a plurality of said building reinforcements according to claim 2, wherein the opening extends across the width of the panels between two said fold lines of said L-shaped elements.

4. A building structure comprising said modular assembly of a plurality of said building reinforcements according to claim 1, wherein the opening is circular in shape.

5. A building structure comprising said modular assembly of a plurality of said building reinforcements according to claim 1, wherein the opening is oval, elliptical or hexagonal in shape.

6. A building structure comprising said modular assembly of a plurality of said building reinforcements according to claim 5, wherein the major axis of the elliptical opening extends perpendicularly with respect to each said fold line.

7. A building structure comprising said modular assembly of a plurality of said building reinforcements according to claim 1, wherein said building reinforcement is sub-divided into only three panels.

8. A building structure comprising said modular assembly of a plurality of said building reinforcements according to claim 1, wherein one of said panels has a different surface area than the other of said panels.

9. A building structure comprising said modular assembly of a plurality of said building reinforcements according to claim 1, wherein each said fold line is defined by a line of weakness formed by scoring, stamping or partially cutting the steel plate.

10. A building structure comprising said modular assembly of a plurality of said building reinforcements according to claim 1, wherein the base panel is provided with said opening dimensioned to allow the passage of a reinforcement or stabilizing material and at least one of the two sidewall panels is provided with an opening dimensioned to allow the passage of a reinforcement or stabilizing material.

11. A building structure comprising said modular assembly of a plurality of said building reinforcements according to claim 1 comprising the reinforcement or stabilizing material disposed into volumes defined by the base, sidewalls and a lid of adjacent said building reinforcements.

12. A building structure comprising said modular assembly of a plurality of said building reinforcements according to claim 11 wherein the building structure is a reinforced structural wall adapted to form a spent fuel pool.

13. A building structure comprising said modular assembly of a plurality of said building reinforcements according to claim 1 wherein a length and width of said base panel is the same as a length and width of each of said sidewall panels.

14. A building structure comprising said modular assembly of a plurality of said building reinforcements according to claim 1 wherein a length and width of said base panel is different than a length and width of said sidewall panels.

15. A building structure comprising a modular assembly of a plurality of building reinforcements comprising:

two separate L-shaped elements that form an opening dimensioned to allow the passage of a reinforcement or stabilizing material, said L-shaped elements being joined together to assemble said building reinforcement that is three-dimensional and defines a U-shaped channel, each of said L-shaped elements including mutually perpendicular panels;

each of said L-shaped elements being formed of a steel plate having a thickness of between 6 mm and 25 mm and being sub-divided by a fold line into said panels;

each said panel being deformed along said fold line out of a common plane to form the L-shaped elements, wherein each said building reinforcement comprises only a base panel and two sidewall panels which together define said U-shaped channel;

reinforcement or stabilizing material disposed into volumes defined by the base, sidewalls and a lid of adjacent said building reinforcements;

wherein a plurality of said building reinforcements are connected together to form said modular assembly;

wherein the building structure is selected from a wall, ceiling or floor.

16. A building structure comprising said modular assembly of a plurality of said building reinforcements according to claim 15, wherein the reinforcement or stabilizing material is selected from concrete, resin, asphalt and particulate aggregate.

17. A building structure comprising said modular assembly of a plurality of said building reinforcements according to claim 16, wherein the building structure is a reinforced structural wall.

18. A building structure comprising said modular assembly of a plurality of said building reinforcements according to claim 16, wherein the building structure is a reinforced structural wall adapted to form a spent fuel pool.

19. A building structure comprising said modular assembly of a plurality of said building reinforcements according to claim 15 wherein a length and width of said base panel of said building reinforcement is the same as a length and width of each of said sidewall panels of said building reinforcement.

20. A building structure comprising said modular assembly of a plurality of said building reinforcements according to claim 15 wherein a length and width of said base panel is different than a length and width of said sidewall panels.

21. A building structure comprising said modular assembly of a plurality of said building reinforcements according to claim 15, wherein the fold lines of said L-shaped elements are each straight and mutually parallel.

22. A building structure comprising said modular assembly of a plurality of said building reinforcements according to claim 15, wherein the opening extends across the width of the panels between two said fold lines of said L-shaped elements.

23. A building structure comprising said modular assembly of a plurality of said building reinforcements according to claim 15, wherein the opening is circular in shape.

24. A building structure comprising said modular assembly of a plurality of said building reinforcements according to claim 15 wherein the opening is oval, elliptical or hexagonal in shape.

25. A building structure comprising said modular assembly of a plurality of said building reinforcements according to claim 15 wherein the major axis of the elliptical opening extends perpendicularly with respect to each said fold line.

26. A building structure comprising said modular assembly of a plurality of said building reinforcements according to claim 15, wherein said building reinforcement is subdivided into only three panels.

27. A building structure comprising said modular assembly of a plurality of said building reinforcements according to claim 15, wherein one of said panels has a different surface area than the other of said panels.

28. A building structure comprising said modular assembly of a plurality of said building reinforcements according to claim 15, wherein each said fold line is defined by a line of weakness formed by scoring, stamping or partially cutting the steel plate.

* * * * *